US010625509B2

(12) United States Patent
Kuno

(10) Patent No.: US 10,625,509 B2
(45) Date of Patent: Apr. 21, 2020

(54) LIQUID STORAGE DEVICE

(71) Applicant: BROTHER KOGYO KABUSHIKI KAISHA, Nagoya-shi, Aichi-ken (JP)

(72) Inventor: Daisuke Kuno, Kariya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/232,671

(22) Filed: Dec. 26, 2018

(65) Prior Publication Data

US 2019/0193408 A1 Jun. 27, 2019

(30) Foreign Application Priority Data

Dec. 27, 2017 (JP) ..... 2017-252023

(51) Int. Cl.
*B41J 2/175* (2006.01)
*B41J 29/38* (2006.01)
*B41J 29/02* (2006.01)

(52) U.S. Cl.
CPC ..... *B41J 2/17513* (2013.01); *B41J 2/175* (2013.01); *B41J 2/17523* (2013.01); *B41J 2/17563* (2013.01); *B41J 2/17566* (2013.01); *B41J 29/02* (2013.01); *B41J 29/38* (2013.01); *B41J 2002/17569* (2013.01); *B41J 2002/17573* (2013.01); *B41J 2002/17579* (2013.01)

(58) Field of Classification Search
CPC ..... B41J 2/16523; B41J 2/16505; B41J 2/16508; B41J 2/1652; B41J 2/16532; B41J 2/16535; B41J 2/16552; B41J 2/1707; B41J 2/175; B41J 2/17509; B41J 2/17523; B41J 2/17513; B41J 2/17563; B41J 2/17566; B41J 2/17596; B41J 2/18; B41J 29/02; B41J 29/38; B41J 2202/17569; B41J 2202/17573; B41J 2202/17579
See application file for complete search history.

(56) References Cited

U.S. PATENT DOCUMENTS 8,270,880 B2 * 9/2012 Kato ..... G03G 15/105 399/120
2009/0189931 A1 7/2009 Noro et al.

FOREIGN PATENT DOCUMENTS

JP 2006-001171 A 1/2006
JP 2009-202565 A 9/2009
JP 2014-166741 A 9/2014

OTHER PUBLICATIONS

New U.S. Patent Application claiming priority to JP Patent Application No. 2017-252027 filed on Dec. 27, 2017. (Client/Brother Ret Nos. 17290BRK21/2017-00147US00).

* cited by examiner

*Primary Examiner* — Thinh H Nguyen
(74) *Attorney, Agent, or Firm* — K&L Gates LLP

(57) ABSTRACT

A liquid storage device includes a tank, a shaft, an agitator blade, a first tube, a second tube, and a fixing member. The tank is configured to store ink to be supplied to an inkjet head. The shaft is configured to be inserted inside the tank via an insertion hole provided in the tank. The agitator blade is disposed inside the tank and is connected to the shaft. The first tube is configured to supply the ink to the inkjet head. The second tube is configured to return the ink to the tank. The fixing member is disposed in a position higher than the agitator blade, and is configured to fix the first tube and the second tube.

8 Claims, 5 Drawing Sheets

LIQUID STORAGE DEVICE

CROSS-REFERENCE TO RELATED APPLICATION

This application claims priority to Japanese Patent Application No. 2017-252023 filed on Dec. 27, 2017, the disclosure of which is herein incorporated by reference in its entirety.

BACKGROUND

The present disclosure relates to a liquid storage device.

A liquid storage device is known that is provided in an inkjet printer. The liquid storage device is provided with an ink storage portion that stores ink. A propeller member that is attached to a shaft and an ink supply path are provided inside the ink storage portion. The propeller member rotates in concert with the rotation of the shaft and agitates the ink. The ink supply path supplies the ink from the ink storage portion to an inkjet head.

SUMMARY

In the above-described liquid storage device, there is a possibility that the ink supply path may move when the propeller member agitates the ink. Thus, there is a possibility that the ink supply path may become entangled with the shaft and cause an agitation defect.

Various embodiments of the general principles described herein provide a liquid storage device that reduces a possibility of causing an agitation defect when agitating an ink or a recording material.

Embodiments herein provide a liquid storage device that includes a tank, a shaft, an agitator blade, a first tube, a second tube, and a fixing member. The tank is configured to store ink to be supplied to an inkjet head. The shaft is configured to be inserted inside the tank via an insertion hole provided in the tank. The agitator blade is disposed inside the tank and is connected to the shaft. The first tube is configured to supply the ink to the inkjet head. The second tube is configured to return the ink to the tank. The fixing member is disposed in a position higher than the agitator blade, and is configured to fix the first tube and the second tube.

Embodiments herein also provide a liquid storage device that includes a tank, a shaft, an agitator blade, a first tube, a second tube, and a fixing member. The tank is configured to store a recording material to be ejected onto a recording medium. The shaft is configured to be inserted inside the tank via an insertion hole provided in the tank. The agitator blade is disposed inside the tank and is connected to the shaft. The first tube is configured to supply the recording material to an ejection head. The second tube is configured to return the recording material to the tank. The fixing member is disposed in a position higher than the agitator blade, and is configured to fix the first tube and the second tube.

BRIEF DESCRIPTION OF THE DRAWINGS

Embodiments will be described below in detail with reference to the accompanying drawings in which.

DETAILED DESCRIPTION

Hereinafter, as an example of the liquid storage device of the present disclosure, a print device 1 will be explained with reference to the drawings. An overview of the print device 1 will be explained with reference to FIG. 1. The upward direction, the downward direction, the left downward direction, the right upward direction, the right downward direction and the left upward direction in FIG. 1 respectively correspond to an upward direction, a downward direction, a front direction, a rear direction, a right direction and a left direction of the print device 1.

Figure 2:
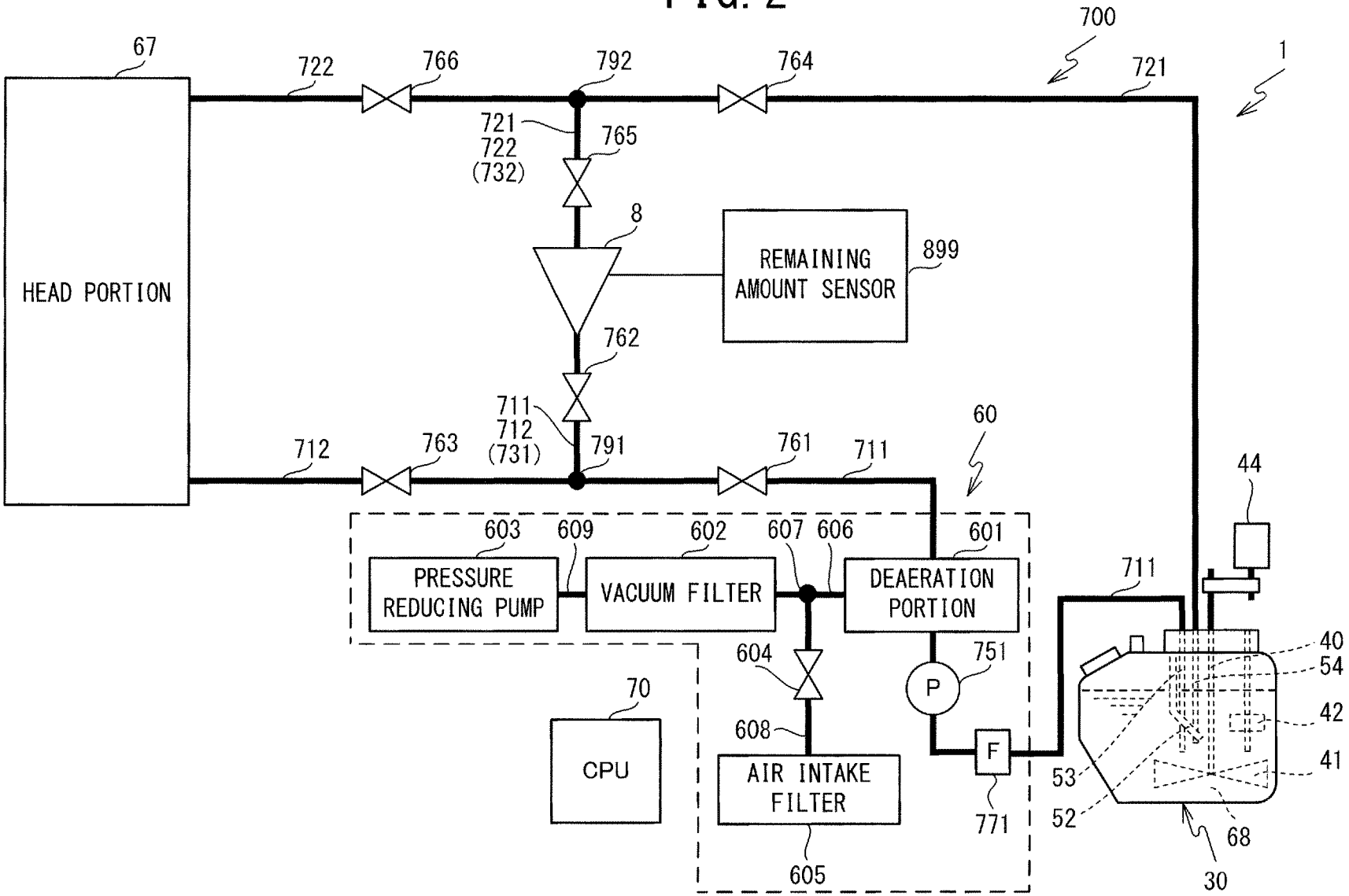
FIG. 2 is a diagram schematically showing a configuration of the print device.

The print device 1 is an inkjet printer that performs printing on a fabric such as a T-shirt, or a recording medium such as paper, by ejecting an ink 68 (refer to FIG. 2) from nozzles of a head portion 67 (refer to FIG. 2). The print device 1 prints a color image on the recording medium by downwardly ejecting, for example, five different types (white (W), black (K), yellow (Y), cyan (C) and magenta (M)) of the ink 68. In the following explanation, of the five types of the ink 68, the white ink 68 is referred to as white ink. The four colors of the ink 68, i.e., the black, cyan, yellow and magenta inks, are collectively referred to as color inks. The white ink is an ink having higher settleability than the color inks.

Figure 1:
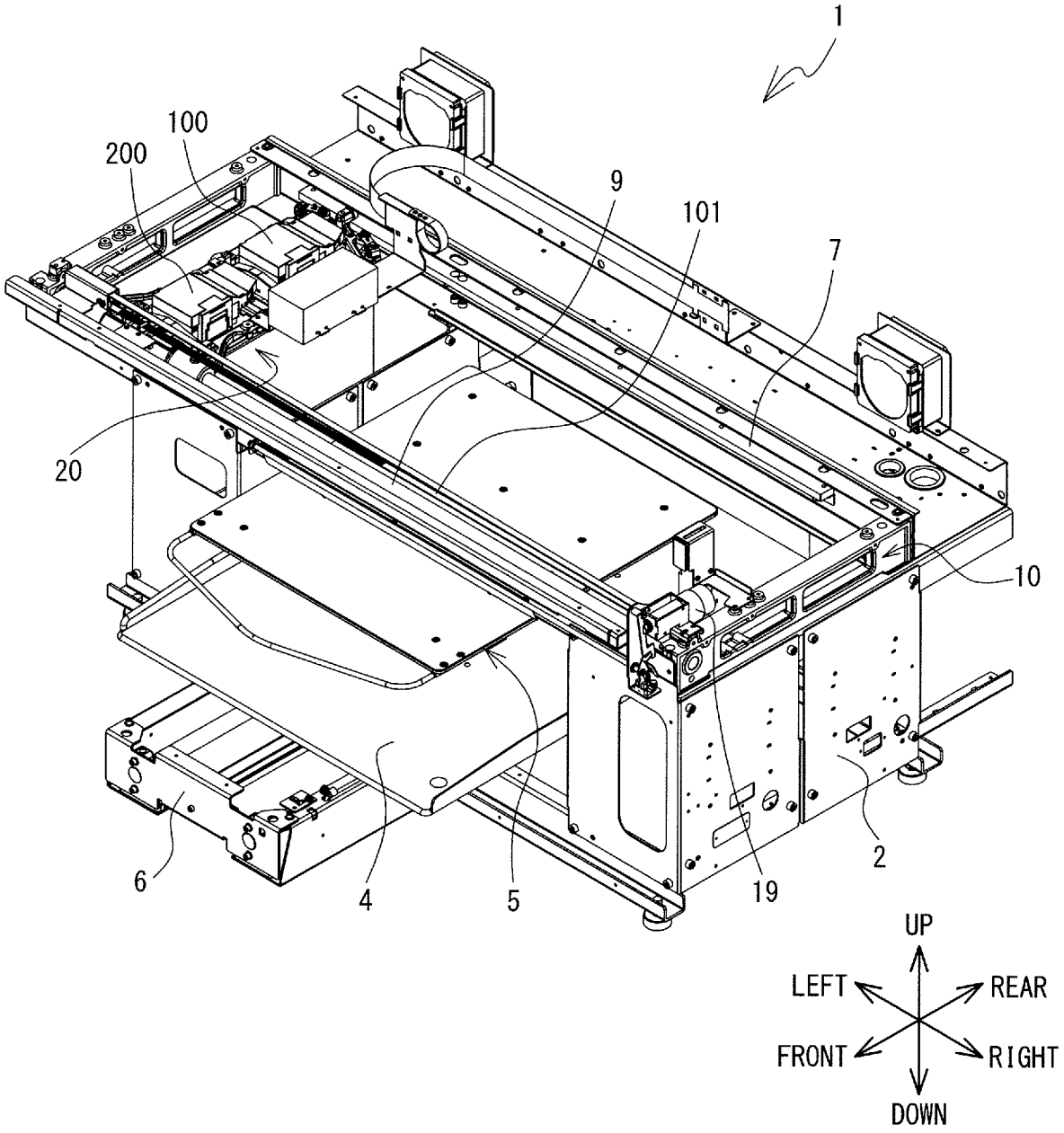
FIG. 1 is a perspective view of a print device.

As shown in FIG. 1, the print device 1 is provided with a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101, and a drive motor 19. An operating portion (not shown in the drawings) that is used to perform operations of the print device 1 is provided at a front position on the right side of the housing 2. The operating portion is operated when an operator inputs commands relating to various operations of the print device 1.

The frame body 10 has a substantially rectangular frame shape in a plan view, and is installed on an upper portion of the housing 2. The front side of the frame body 10 supports the guide shaft 9, and the rear side of the frame body 10 supports the rail 7. The guide shaft 9 extends in the left-right direction on the inside of the frame body 10. The rail 7 is disposed facing the guide shaft 9 and extends in the left-right direction.

The carriage 20 is supported such that the carriage 20 can be conveyed in the left-right direction along the guide shaft 9. The head units 100 and 200 are mounted on the carriage 20 such that the head units 100 and 200 are aligned in the front-rear direction. The head unit 100 is positioned further to the rear than the head unit 200. The head portion 67 (refer to FIG. 2) is provided on a lower portion of each of the head units 100 and 200. The head portion 67 of the head unit 100 ejects the white ink. The head portion 67 of the head unit 200 ejects the color inks. The head portion 67 is provided with a surface having a plurality of fine nozzles (not shown in the drawings) that can eject the ink 68 downward.

As shown in FIG. 1, the drive belt 101 is stretched along the left-right direction on the inside of the frame body 10. The drive motor 19 is coupled to the carriage 20 via the drive belt 101. When the drive motor 19 drives the drive belt 101, the carriage 20 is caused to reciprocate in the left-right direction along the guide shaft 9.

The platen drive mechanism 6 is provided with the pair of guide rails (not shown in the drawings) and a platen support base (not shown in the drawings). The pair of guide rails extend in the front-rear direction on the inside of the platen drive mechanism 6, and support the platen support base such that the platen support base can move in the front-rear direction. An upper portion of the platen support base supports the platen 5. The platen 5 supports the recording medium. The tray 4 is provided below the platen 5. When the operator places a T-shirt or the like on the platen 5, the tray 4 receives a sleeve or the like of the T-shirt, and thus protects the sleeve or the like such that the sleeve or the like does not come into contact with other components provided inside the housing 2. The platen drive mechanism 6 is driven by a sub-scanning drive portion (not shown in the drawings), and moves the platen support base and the platen 5 along the pair of guide rails in the front-rear direction. Printing by the print device 1 on the recording medium is performed by the platen 5 conveying the recording medium in the front-rear direction (a sub-scanning direction) and the ink 68 being ejected from the head portion 67 that is reciprocating in the left-right direction (a main scanning direction).

As shown in FIG. 2, the print device 1 is provided with a CPU 70 and an ink supply portion 700. FIG. 2 is a diagram schematically showing the configuration of the print device 1, and thus, an arrangement of a first tube 53 and a second tube 54 to be described later is different to that in FIG. 3 to FIG. 5. The CPU 70 controls the print device 1 in accordance with a program. An ink supply portion 700 that supplies each of the four color inks 68 to the head portion 67 of the head unit 200 may also have a configuration similar to that shown in FIG. 2. Below, the print device 1 will be explained using a configuration relating to the white ink 68.

Figure 3:
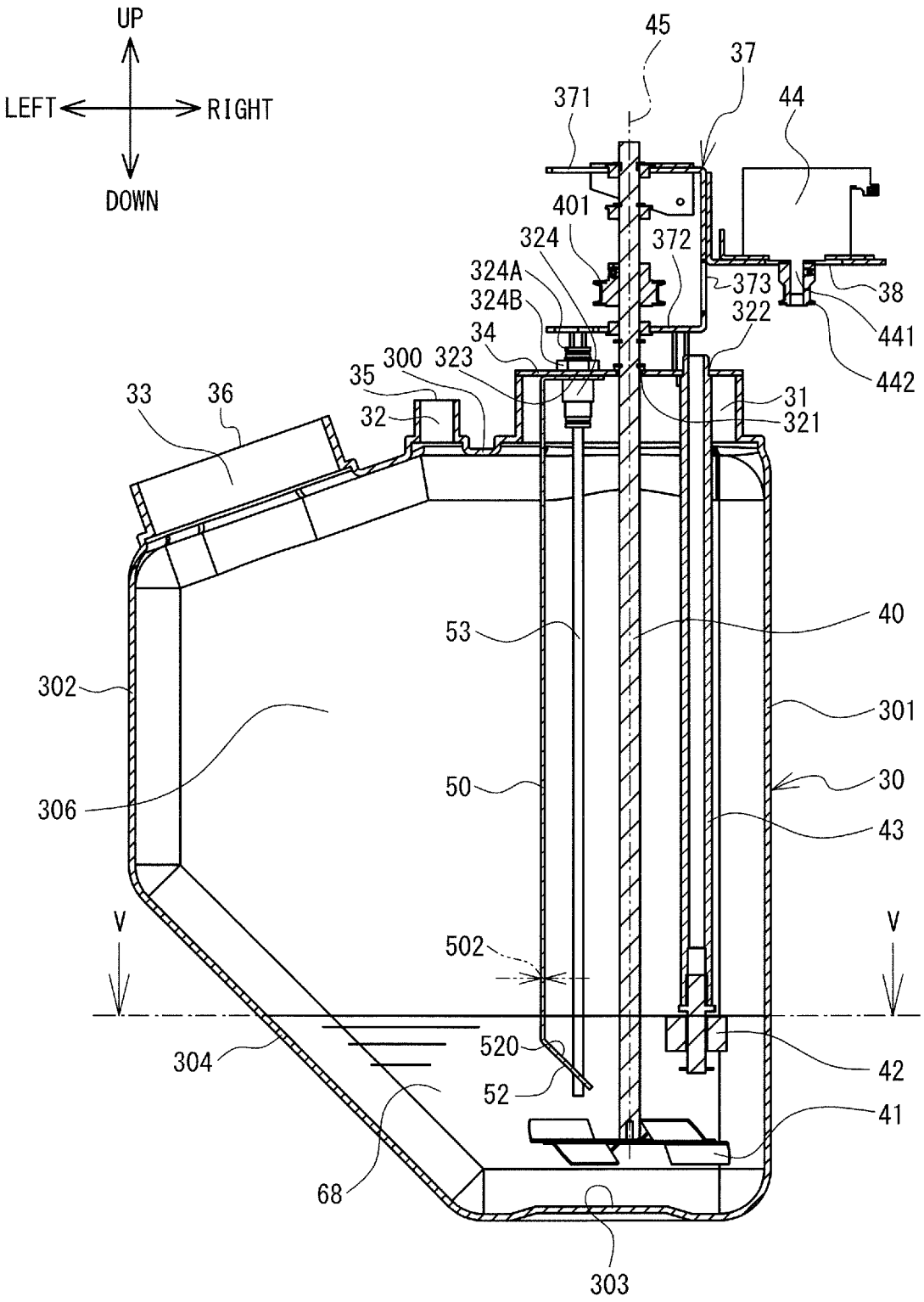
FIG. 3 is a vertical cross-section of a main tank.
Figure 4:
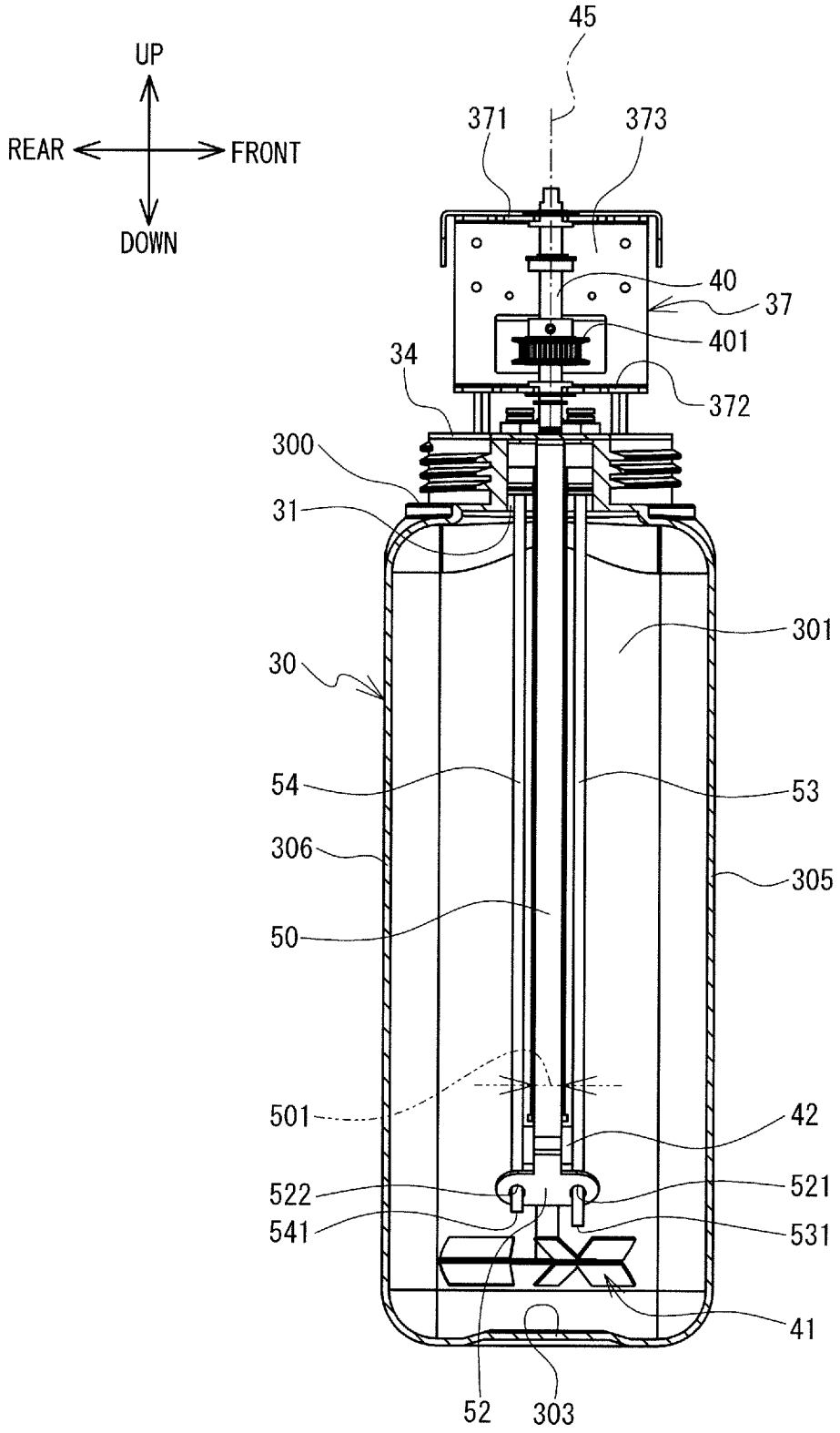
FIG. 4 is a vertical cross-section of the main tank, along a plane that is orthogonal to the view in FIG. 3.

As shown in FIGS. 2 to 4, the print device 1 is provided with a main tank 30, a shaft 40, an agitator blade 41, the first tube 53, the second tube 54, a fixing member 52, a remaining amount sensor 42, and a motor 44. The main tank 30 stores the ink 68. The ink 68 stored in the main tank 30 is supplied to the ink supply portion 700, and the ink 68 returning from the ink supply portion 700 is stored once more in the main tank 30. An amount that can be stored in the main tank 30 is greater than an amount that can be stored in a sub pouch 8 to be described later. The motor 44 rotates the shaft 40. The ink 68 is agitated by the agitator blade 41 rotating due to the rotation of the shaft 40. The first tube 53 is connected to a first supply flow path 711 to be described later, and supplies the ink 68 in the main tank 30 to the head portion 67. The second tube 54 is connected to a first circulation flow path 721 to be described later, and returns the ink 68 to the main tank 30. The fixing member 52 fixes the first tube 53 and the second tube 54. The remaining amount sensor 42 detects a remaining amount of the ink 68 in the main tank 30.

[Main Tank 30]

As shown in FIG. 3, the main tank 30 is provide with an upper portion 300, a bottom portion 303, a right side surface 301, a left side surface 302, and an inclined surface 304. The left side surface 302 is shorter than the right side surface 301, and a position of the lower end portion of the left side surface 302 is higher than a position of the lower end portion of the right side surface 301. The inclined surface 304 connects the lower end portion of the left side surface 302 and the left end portion of the bottom portion 303. As shown in FIG. 4, the main tank 30 is provided with a front surface 305 and a rear surface 306. As shown in FIG. 3, a container opening portion 31, a container opening portion 32, and a container opening portion 33, which are openings, are provided in the upper portion 300. The container opening portion 31, the container opening portion 32, and the container opening portion 33 are respectively closed by a lid 34, a lid 35, and a lid 36. When filling the main tank 30 with the ink 68, the lid 36 is removed, and the ink 68 is supplied into the main tank 30 from the container opening portion 33.

An insertion hole 321, an insertion hole 322, and an insertion hole 323 are provided in the lid 34. The shaft 40 is inserted into the interior of the main tank 30 via the insertion hole 321. A support shaft 43 that supports the remaining amount sensor 42 is fixed to the insertion hole 322. A partition wall fixing member 324 is provided in the insertion hole 323. The partition wall fixing member 324 is internally provided with an through hole (not shown in the drawings), and a screw portion 324A is formed in an upper portion of the partition wall fixing member 324. The partition wall fixing member 324 is fixed to the insertion hole 323 of the lid 34 by the screw portion 324A and a nut 324B. The first tube 53 and the second tube 54 are fixed to the through hole on the internal side in the partition wall fixing member 324, and are inserted inside the main tank 30.

[Shaft 40 and Agitator Blade 41]

Figure 5:
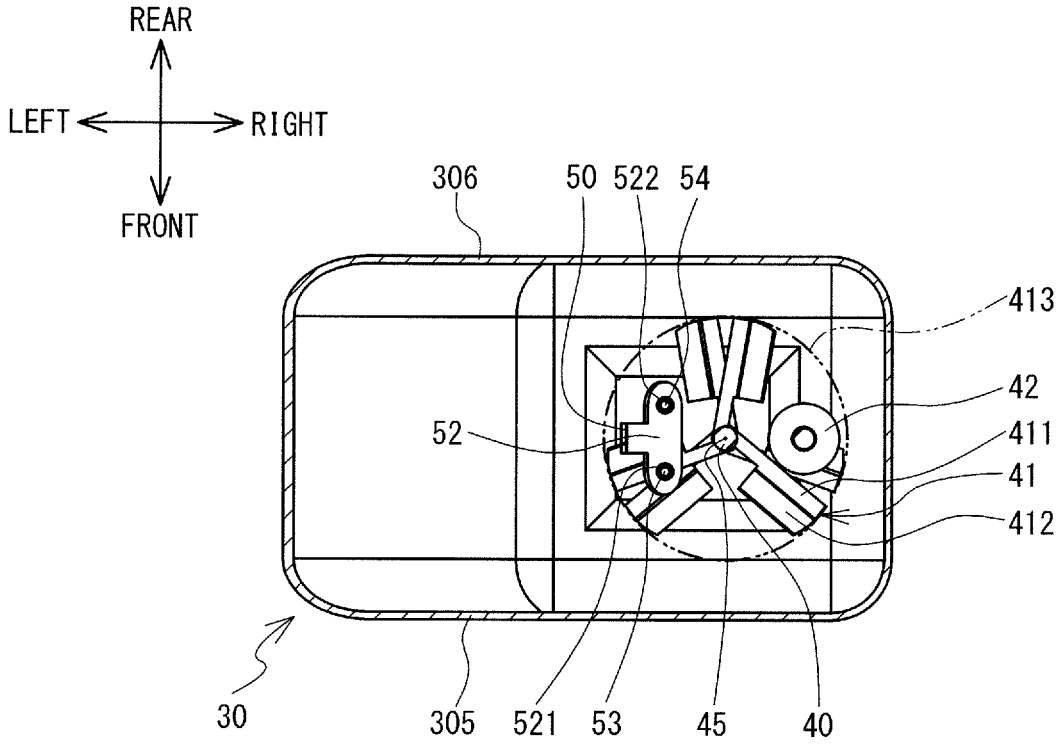
FIG. 5 is a cross-section along a line V-V of a liquid storage device shown in FIG. 3.

As shown in FIG. 3, the shaft 40 is a cylindrically shaped rotating shaft that extends in the up-down direction, and rotates around an axis line 45. The agitator blade 41 is connected to the lower end portion of the shaft 40. Thus, the agitator blade 41 is provided on the side of the bottom portion 303 inside the main tank 30. As shown in FIG. 5, the agitator blade 41 is provided with a plurality of shaft portions 411 that extend at equal intervals from the shaft 40, and blade portions 412 that are respectively fixed to each of the shaft portions 411. A shape of the blade portion 412 is preferably a predetermined shape that sends the ink 68 toward the upper portion 300 of the main tank 30 due to the rotation of the shaft 40. The predetermined shape is an inclined shape, for example.

As shown in FIG. 3, a frame 37 is provided above the lid 34. The frame 37 includes an upper wall 371, a lower wall 372, and a right wall 373. The upper wall 371 and the lower wall 372 extend in parallel to each other while being separated from each other in the up-down direction by a predetermined interval, and are connected to each other by the right wall 373. The frame 37 rotatably supports the shaft 40. A motor support base 38 is provided on the right wall 373. The motor support base 38 supports the motor 44. A rotating shaft 441 of the motor 44 penetrates the motor support base 38 and protrudes downward. A pulley 442 is fixed to the rotating shaft 441. A pulley 401 is also fixed to the upper portion of the shaft 40. A belt (not shown in the drawings) is stretched between the pulley 401 and the pulley 442. Thus, the shaft 40 rotates when the rotating shaft 441 of the motor 44 rotates due to control of a CPU 70. The agitator blade 41 rotates due to the rotation of the shaft 40. When the agitator blade 41 rotates, the ink 68 that has collected on the bottom portion 303 side of the main tank 30 moves toward the upper portion 300. Thus, the ink 68 is agitated. As a result, a possibility is reduced that components of the ink 68 may precipitate in the main tank 30.

[Fixing Member 52]

The fixing member 52 is provided with a rod 50. The rod 50 extends in the up-down direction in line with the shaft 40. The upper end portion of the rod 50 is fixed to the lid 34 by the screw portion 324A and the nut 324B of the partition wall fixing member 324, and the lower end portion of the rod 50 is connected to the fixing member 52. The rod 50 is a plate-shaped rod that is provided with a short side 502 shown in FIG. 3 and a long side 501 shown in FIG. 4. An extending direction of the short side 502 is a direction oriented toward the shaft 40, namely, the rightward direction in FIG. 3. The fixing member 52 is an elliptically-shaped plate member, and has a connecting portion that connects with the lower end portion of the rod 50. The fixing member 52 has an inclined surface 520. The inclined surface 520 is inclined diagonally downward toward the shaft 40, namely, is inclined downward toward the right in FIG. 3. As shown in FIG. 4 and FIG. 5, the fixing member 52 is provided with a circular opening 521, and a circular opening 522. A lower end 531 of the first tube 53 is inserted through the opening 521, and a lower end 541 of the second tube 54 is inserted through the opening 522. The fixing member 52 respectively inserts the first tube 53 and the second tube 54 into the opening 521 and the opening 522, and fixes the first tube 53 and the second tube 54.

As shown in FIG. 4, the lower end 531 of the first tube 53 is positioned lower than the lower end 541 of the second tube 54. As shown in FIG. 3, the fixing member 52 is arranged at a height equal to or lower than an arrangement position of the remaining amount sensor 42. As shown in FIG. 5, the fixing member 52 is arranged such that the fixing member 52 overlaps with a rotation area 413 of the agitator blade 41 when seen from above or from below. For example, the rotation area 413 of the agitator blade 41 is an area inside a circle having as a radius a distance from the axis line 45 of the shaft 40 to an outermost periphery of the agitator blade 41. When seen from above or from below, the fixing member 52 is arranged in a position within the rotation area 413.

[Remaining Amount Sensor 42]

The remaining amount sensor 42 is provided on the lower end portion side of the support shaft 43. The remaining amount sensor 42 is provided at a predetermined height inside the main tank 30 at which a remaining amount of the ink 68 is detected. For example, the remaining amount sensor 42 is a float sensor that detects a liquid surface by the up and down movement of a float. The remaining amount sensor 42 outputs, to the CPU 70, a signal indicating the remaining amount of the ink 68 stored in the main tank 30. The CPU 70 detects the remaining amount of the ink 68 in the main tank 30 on the basis of the signal output by the remaining amount sensor 42.

[Ink Supply Portion 700]

The ink supply portion 700 is a portion that supplies the ink 68 to the head portion 67 and circulates the ink 68. The ink supply portion 700 is provided with the sub pouch 8, the first supply flow path 711, a second supply flow path 712, the first circulation flow path 721, a second circulation flow path 722, a first connection flow path 731, a second connection flow path 732, electromagnetic valves 761, 762, 763, 764, 765, and 766, a filter 771, a pump 751, and a deaeration module 60.

The sub pouch 8 has a bag shape and stores the ink 68 supplied from the main tank 30. The sub pouch 8 supplies the ink 68 to the head portion 67. The head portion 67 ejects the ink 68 supplied from the sub pouch 8 and thus performs printing on a recording medium. A remaining amount sensor 899 is mounted on the sub pouch 8.

The first supply flow path 711, the second supply flow path 712, the first circulation flow path 721, the second circulation flow path 722, the first connection flow path 731, and the second connection flow path 732 are each formed by a hollow tube, for example. The first supply flow path 711 connects to the first tube 53 and to the sub pouch 8, and is a flow path that supplies the ink 68 from the main tank 30 to the sub pouch 8.

The second supply flow path 712 connects to the sub pouch 8 and to the head portion 67, and is a flow path that supplies the ink 68 from the sub pouch 8 to the head portion 67. The first supply flow path 711 and the second supply flow path 712 converge at a first connection portion 791. The first connection flow path 731 is a flow path between the first connection portion 791 and the sub pouch 8. That is, the first connection flow path 731 is a part of the first supply flow path 711 and is also a part of the second supply flow path 712.

The first circulation flow path 721 connects to the second tube 54 and to the sub pouch 8, and is a flow path to circulate the ink 68 from the sub pouch 8 to the main tank 30. The second circulation flow path 722 connects to the head portion 67 and to the sub pouch 8, and is a flow path to circulate the ink 68 from the head portion 67 to the sub pouch 8. The first circulation flow path 721 and the second circulation flow path 722 converge at a second connection portion 792. The second connection flow path 732 is a flow path between the second connection portion 792 and the sub pouch 8. That is, the second connection flow path 732 is a part of the first circulation flow path 721 and is also a part of the second circulation flow path 722.

The electromagnetic valve 761 is provided in the first supply flow path 711. The electromagnetic valve 761 is positioned closer to the sub pouch 8 than a deaeration portion 601 to be described later. The electromagnetic valve 761 is controlled by the CPU 70, and opens and closes the first supply flow path 711. The electromagnetic valve 762 is provided in the first connection flow path 731. The electromagnetic valve 762 is controlled by the CPU 70, and opens and closes the first connection flow path 731. The electromagnetic valve 763 is provided in the second supply flow path 712. The electromagnetic valve 763 is controlled by the CPU 70, and opens and closes the second supply flow path 712.

The electromagnetic valve 764 is provided in the first circulation flow path 721. The electromagnetic valve 764 is controlled by the CPU 70, and opens and closes the first circulation flow path 721. The electromagnetic valve 765 is provided in the second connection flow path 732. The electromagnetic valve 765 is controlled by the CPU 70, and opens and closes the second connection flow path 732. The electromagnetic valve 766 is provided in the second circulation flow path 722. The electromagnetic valve 766 is controlled by the CPU 70, and opens and closes the second circulation flow path 722.

The filter 771 is provided in the first supply flow path 711. The filter 771 removes foreign matter contained in the ink 68 that flows through the first supply flow path 711. The pump 751 is provided in the first supply flow path 711. The pump 751 is provided closer to the sub pouch 8 than the filter 771. The pump 751 sucks up the ink 68 from the main tank 30 and causes the ink 68 to flow to the sub pouch 8 side, which is the downstream side.

The deaeration module 60 is provided in the first supply flow path 711. The deaeration module 60 is provided with the deaeration portion 601, a vacuum filter 602, a pressure reducing pump 603, an electromagnetic valve 604, an air intake filter 605, a pathway 606, a pathway 608, and a pathway 609. The deaeration portion 601 is provided in the first supply flow path 711. The deaeration portion 601 is positioned between the pump 751 and the electromagnetic valve 761. The vacuum filter 602 is connected to the deaeration portion 601 via the pathway 606. The pathway 606 is connected to the pathway 608 at a connection portion 607. The air intake filter 605 is connected to the pathway 608. The electromagnetic valve 604 is provided in the pathway 608. The pressure reducing pump 603 is connected to the vacuum filter 602 via the pathway 609.

The pressure reducing pump 603 operates under the control of the CPU 70, and depressurizes the pathway 606 via the vacuum filter 602. Therefore, air bubbles contained in the ink 68 flowing through the deaeration portion 601 are reduced. When the pathway 606 is depressurized, the electromagnetic valve 604 is controlled by the CPU 70, and closes the pathway 608. When the pathway 606 is not depressurized, the electromagnetic valve 604 is controlled by the CPU 70, and opens the pathway 608. When the pathway 608 is opened, ambient air is supplied to the pathway 606 via the air intake filter 605 and the pathway 606. Thus, the depressurized state of the pathway 606 is released. The air intake filter 605 removes foreign matter from the ambient air flowing to the pathway 608 side.

In the above-described embodiment, the fixing member 52 fixes the first tube 53 and the second tube 54, and thus, the possibility can be reduced of the first tube 53 and the second tube 54 moving due to the flow of the ink 68 when the ink 68 is agitated by the agitator blade 41. Thus, the possibility can be reduced of the first tube 53 and the second tube 54 becoming entangled with the shaft 40. Further, the first tube 53 and the second tube 54 do not obstruct the rotation of the shaft 40, and thus, the possibility can be reduced of an agitation defect of the ink 68 occurring. Therefore, the possibility can be reduced of the filter 771, the first supply flow path 711, the second supply flow path 712, the first circulation flow path 721, the second circulation flow path 722, the first connection flow path 731, or the second connection flow path 732 becoming clogged.

The lower end 531 of the first tube 53 is positioned lower than the lower end 541 of the second tube 54. As a result, the possibility can be reduced of air entering into the first tube 53 when the ink 68 returning from the second tube 54 to the main tank 30 includes air. Further, when the ink 68 is initially introduced into the ink supply portion 700, even if air inside the flow path is transferred to the main tank 30 from the first circulation flow path 721 through the second tube 54, the possibility can be reduced of the air entering into the first tube 53.

The fixing member 52 overlaps with the rotation area 413 of the agitator blade 41 when seen from above or from below. Thus, precipitate that falls from inside the first tube 53 and the second tube 54 falls inside the rotation area 413 of the agitator blade 41. There is a case in which the ink 68 includes a pigment that has settleability for example. The precipitated pigment falls through the inside of the first tube 53 or the second tube 54 as the precipitate, and falls inside the rotation area 413 of the agitator blade 41. Thus, the possibility is increased that the precipitate is stirred into the ink 68 by the rotation of the agitator blade 41. Further, the possibility is increased that the precipitate accumulated on the fixing member 52 is stirred into the ink 68 by the rotation of the agitator blade 41.

The fixing member 52 is arranged at the height equal to or lower than the arrangement position of the remaining amount sensor 42. The remaining amount sensor 42 detects the liquid surface of the ink 68 before the liquid surface of the ink 68 falls to a height that is equal to or lower than the fixing member 52. Thus, the possibility can be reduced that the precipitate accumulated on the fixing member 52 is exposed above the liquid surface of the ink 68. As a result, the possibility can be reduced that the precipitate accumulated on the fixing member 52 hardens.

The fixing member 52 has the inclined surface 520, and thus, the precipitate falls along the inclined surface 520. Thus, the possibility can be reduced that the precipitate accumulates on the fixing member 52. The inclined surface 520 is inclined diagonally downward toward the shaft 40, and therefore, the precipitate falls toward the shaft 40 along the inclined surface 520. As a result, the precipitate is stirred into the ink 68 by the agitator blade 41.

The extending direction of the short side 502 of the rod 50 that supports the fixing member 52 is oriented toward the shaft 40. Thus, when agitating the ink 68, the flow of the ink 68 is directed toward the short side 502 of the rod 50. In contrast, when the extending direction of the long side 501 of the rod 50 is oriented toward the shaft 40, when agitating the ink 68, the flow of the ink 68 is directed toward the long side 501 of the rod 50. Thus, when agitating the ink 68, it is possible to reduce resistance to the flow of the ink 68 when the extending direction of the short side 502 is oriented toward the shaft 40, in comparison to when the extending direction of the long side 501 is oriented toward the shaft 40. As a result, the possibility can be reduced of the agitation defect of the ink 68 occurring.

The present disclosure is not limited to the embodiment that is described above, and various types of modifications can be made. For example, the main tank 30 may be provided separately from the print device 1, and may be provided in a liquid storage device having an ejection portion that ejects a recording material onto a recording medium using a spray or the like, for example. The present disclosure is particularly effective when the recording material has a high settleability. The recording material is not limited to the ink 68 and may be a discharge agent, a pretreatment agent and the like. The remaining amount sensor 42 is not limited to the float sensor and may be an electrode type sensor, an electrostatic capacitance type sensor, an optical type sensor, a differential pressure type sensor or the like that is capable of detecting a level of a liquid. The fixing member 52 is not limited to the elliptically-shaped member. The shape may be rectangular, an oval shape or the like. The shape and the number of the agitator blade 41 is not limited to the shape and the number described above. It is sufficient that the shape and number be able to agitate the ink 68. The main tank 30 is not limited to the above-described shape, and it is sufficient that the main tank 30 be capable of storing the ink 68. The configuration of the deaeration module 60 may be a configuration different to that of the above-described embodiment. The deaeration module need not necessarily be provided. The filter 771 need not necessarily be provided.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid storage device comprising:

a tank configured to store ink to be supplied to an inkjet head;

a shaft configured to be inserted inside the tank via an insertion hole provided in the tank;

an agitator blade disposed inside the tank and connected to the shaft;

a first tube configured to supply the ink to the inkjet head;

a second tube configured to return the ink to the tank; and a fixing member disposed in a position higher than the agitator blade, and configured to fix the first tube and the second tube.

2. The liquid storage device according to claim 1, wherein a lower end of the first tube is positioned lower than a lower end of the second tube.

3. The liquid storage device according to claim 1, wherein the fixing member overlaps with a rotation area of the agitator blade when seen from above or from below.

4. The liquid storage device according to claim 1, further comprising:

a sensor configured to detect a liquid surface of the ink, wherein the fixing member is disposed at a height equal to or lower than an arrangement position of the sensor.

5. The liquid storage device according to claim 1, wherein the fixing member has an inclined surface.

6. The liquid storage device according to claim 5, wherein the inclined surface is inclined diagonally downward toward the shaft.

7. The liquid storage device according to claim 1, wherein the fixing member includes a rod that extends in line with the shaft, an extending direction of a short side of the rod being oriented toward the shaft.

8. A liquid storage device comprising:

a tank configured to store a recording material to be ejected onto a recording medium;

a shaft configured to be inserted inside the tank via an insertion hole provided in the tank;

an agitator blade disposed inside the tank and connected to the shaft;

a first tube configured to supply the recording material to an ejection head;

a second tube configured to return the recording material to the tank; and a fixing member disposed in a position higher than the agitator blade, and configured to fix the first tube and the second tube.

* * * * *